US010683674B2

(12) United States Patent
Liu

(10) Patent No.: US 10,683,674 B2
(45) Date of Patent: Jun. 16, 2020

(54) POOL WITH AN ELLIPTICAL FRAME

(71) Applicant: BESTWAY INFLATABLES & MATERIAL CORP., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 15/008,125

(22) Filed: Jan. 27, 2016

(65) Prior Publication Data

US 2016/0215513 A1 Jul. 28, 2016

(30) Foreign Application Priority Data

Jan. 27, 2015 (CN) ..... 2015 2 0057049 U
Aug. 27, 2015 (CN) ..... 2015 2 0655645 U

(51) Int. Cl.
*E04H 4/00* (2006.01)
*E04H 4/12* (2006.01)

(52) U.S. Cl.
CPC ..... *E04H 4/0056* (2013.01); *E04H 4/1272* (2013.01)

(58) Field of Classification Search
CPC ..... E04H 4/0056; Y10T 403/4662; Y10T 403/7176; Y10T 24/45105; Y10T 24/303; Y10T 24/309; Y10T 24/4501; Y10T 24/45257; F16B 7/0446; F16B 7/042; F16B 21/125
USPC ..... 4/506, 513
See application file for complete search history.

(56) References Cited

U.S. PATENT DOCUMENTS 1,786,613 A 12/1930 Hooper
3,595,180 A * 7/1971 Swoyer ..... A47B 9/00 108/147.19
3,864,048 A * 2/1975 Parker ..... F16B 7/105 248/188.5
3,874,132 A 4/1975 Mendelow et al.
4,356,933 A 11/1982 Connolly
5,083,327 A 1/1992 Gillebaard
5,592,702 A 1/1997 Gillebaard, Jr.
(Continued)

FOREIGN PATENT DOCUMENTS

CN 203879057 10/2014
FR 2570422 3/1986
GB 1037127 A * 7/1966 ..... E04H 4/005

*Primary Examiner* — Erin Deery
(74) *Attorney, Agent, or Firm* — AJ Moss; Dickinson Wright PLLC

(57) ABSTRACT

A pool with an elliptical frame is disclosed. The pool includes a support frame (A) and a flexible pool liner (B) which is supported by the support frame (A) and is used for containing water. The support frame (A) includes a horizontal and substantially elliptical upper frame (1). A plurality of vertical support members (2) and oblique support members (3) are used for supporting the upper frame (1). Two opposite ends of the upper frame (1) are arranged two opposite arcuate frames (11) along the major axis direction of the elliptical upper frame. Two opposite parallel straight frames (12) having the same length are respectively coupled between the two arcuate frames (11). The arcuate frames (11) and the straight frames (12) form the closed upper frame (1). The wall-mounted filtration apparatus is arranged on the pool using the connecting threads (710) positioned on the water outlet (128) of the pool.

7 Claims, 14 Drawing Sheets

(56) References Cited

U.S. PATENT DOCUMENTS

| | | | | |
|---|---|---|---|---|
| 5,884,347 | A * | 3/1999 | Yurchision | E04H 4/0043 4/488 |
| 6,389,616 | B1 | 5/2002 | Mussa | |
| 6,477,721 | B2 * | 11/2002 | Lee | E04H 4/0056 4/506 |
| 6,571,405 | B1 * | 6/2003 | Saputo | E04H 4/0025 220/613 |
| 6,595,713 | B1 * | 7/2003 | Wilson | F16B 7/042 16/405 |
| 6,643,858 | B2 | 11/2003 | Lee | |
| 2002/0042949 | A1 | 4/2002 | Lee | |
| 2009/0144892 | A1 * | 6/2009 | Brindle | E04H 4/0025 4/506 |
| 2009/0205121 | A1 | 8/2009 | Cheng | |

* cited by examiner

POOL WITH AN ELLIPTICAL FRAME

CROSS REFERENCE

The present application claims priority to Chinese Application No. 201520057049.0, entitled "POOL WITH AN ELLIPTICAL FRAME,", filed on Jan. 27, 2015; Chinese Application No. 201520655645.9, entitled "WALL-MOUNTED FILTRATION APPARATUS FOR A POOL", filed on Aug. 27, 2015, the complete disclosures of which is incorporated by reference herein in its entirety.

FIELD OF THE INVENTION

The present disclosure relates to portable household above ground pools which can be used in courtyard and garden etc., and more particularly to a pool with an elliptical frame having a support frame and a flexible pool liner.

BACKGROUND

Portable household above ground pools may be installed at courtyards, gardens, lawns, or other surfaces for entertaining adults and children, which are advantageously convenient for installation and storage and so on. Above ground pools have many different structures, and can be mainly categorized into frame pools with a metallic (or plastic) frame and frameless pools without a metallic (or plastic) frame. There are a variety of structures and forms for frame pools. However, prior art frame pools have the following major defects.

Firstly, rectangular-framed pools, compared to pools with circular and elliptical frames, require more steel tubes and material cost, and thus making the whole pool heavy and inconvenient to carry. Also, since four sides of the rectangular-framed pools utilize oblique frames, the pools may take up too much space, and thus the installation and usage of the pools will be limited in some relatively narrow locations. Moreover, the steel tubes at the four borders of the upper frame of the rectangular-framed pool are arranged at right angles and are connected without any fixing mechanism. Therefore, a user is susceptible to be injured by the steel tubes of the upper frame at adjacent sides of the pool. Thus, there exists a certain safety risk.

Moreover, circular frame pools have a relatively limited pool length due to the circular shape, which may affect user experience.

Thirdly, conventional pools with an elliptical frame are only provided with support steel tubes on two sides of the pool, and the remaining portions are not provided with any support frame or steel tube. Therefore, the structure of the entire pool is not stable. When a user is in the pool, the pool would somewhat swing with the water. In addition, for the portions that are not supported by any frame, when the pool wall is subjected to a great downward pressure, the water would overflow from the position where the pool wall is pressed downward.

In addition, most pools in markets, for example, SPA pools, above-ground pools and recreation pools are generally used in the outdoor areas. Thus, using the filtration apparatus for eliminating the impurities into the water of pool might be a necessary action for users.

There are different types of filter devices on the market. Most of the large capacity pools have adopted a sand filter setting quartz as filter medium, or a filter pump with filtration core as filer medium. The sand filter having a higher price in the market in comparison with the filter pump has a satisfying filter effect. Additionally, The filter pump with filtration portions inside the pump might not be easy convenience to clean or replace it for pump. Another type of filtration apparatus including the fabric filter portions arranged on the inlet of the pool will not be with a cause using for covering the filter to achieve a purpose of preventing the impurities back into the pool water if the operation of pump is shut off.

SUMMARY

In view of the defects of the prior art, the technical problem to be solved by the present disclosure is to provide a portable pool with an elliptical frame, which has a simple, safe, firm and stable structure as well as an appealing appearance. Also, it is convenient to install and provides high utilization of space.

In order to solve the above-mentioned technical problem, there is provided a pool with an elliptical frame according to the present disclosure. The pool includes a support frame and a flexible pool liner which is supported by the support frame and used for containing water. Moreover, the present disclosure provides a wall-mounted filtration apparatus arranged on the frame pool for filtering the water in the pool.

The pool with an elliptical frame may include a support frame and a flexible pool liner which is supported by the support frame for containing water. The support frame may include a substantially elliptical upper frame which is arranged horizontally; moreover, a plurality of vertical support members and oblique support members may be used for supporting the upper frame; furthermore, the upper frame may include a plurality of arcuate frames which are positioned at two opposite ends of the elliptical upper frame along a major axis direction. A plurality of straight frames are coupled between the arcuate frames in parallel; therefore, the upper frame is configured by combining the arcuate frames and the straight frames.

In one embodiment, each arcuate frame may include at least two first horizontal support tubes, and each straight frame may include at least one second horizontal support tube.

In one embodiment, each straight frame may include at least two second horizontal support tubes. Also, the second horizontal support tubes can be inserted into each other and fixedly coupled via an elastic pin structure.

In one embodiment, a T-shaped connector can be coupled, by the elastic pin structure, between two of the first horizontal support tubes and one of the vertical support members, and between one of the first horizontal support tubes, one of the second horizontal support tubes, and one of the vertical support members.

In one embodiment, a lower surface of the second horizontal support tube may include at least one pair of oblique support holes, or at least one oblique support hole (1211). In addition, a diameter of each oblique support hole can be larger than an external diameter of the oblique support members.

In one embodiment, each of the oblique support members can be a U-shaped tube including two ends which are respectively inserted into the pair of the oblique support holes to support the straight frame.

In one embodiment, each of the oblique support members can be an inverted T-shaped tube including an upper end which is inserted into one of the oblique support holes to support the straight frame.

In one embodiment, the flexible pool liner can be made from a flexible reinforced PVC rubberized fabric or PU rubberized fabric with sandwiched mesh fabric.

In one embodiment, the flexible pool liner may include a pool wall and an elliptical pool bottom. An upper edge of the pool wall can be provided with a plurality of first sleeves allowing the first horizontal support tubes and the second horizontal support tubes of the upper frame to be sheathed therein, so as to fix the flexible pool liner to the upper frame.

In one embodiment, an oblique support tube drawstring can be provided between the pool bottom of the flexible pool liner and a bottom end of the oblique support members; additionally, the oblique support tube drawstring can be fixedly coupled to the pool bottom at one end and be provided with a second sleeve at the other end; moreover, the bottom end of the oblique support members can be sheathed into the second sleeve and the position thereof can be limited by the oblique support tube drawstring.

In one embodiment, each of the vertical support members comprises at least a branched-support member extending from a side of the vertical support member, a support base coupled with an end of the vertical support member and the branched-support member for arranging the vertical support member on the ground.

In one embodiment, an angle between the vertical support member and the branched-support member can be lesser than 90°, and the angle can be in a range of 15° to 45°.

In one embodiment, the branched-support member may include a curved surface extending from a connection portion between the vertical support member and the branched-support member to the end of the branched-support member.

In one embodiment, each of the oblique support members may include at least a branched-tubular portion extending from a side of the oblique support member. Also, a base portion can be coupled with an end of the oblique support member and the branched-tubular portion to support the pool on the ground.

In one embodiment, an angle between the oblique support member and the branched-tubular portion can be lesser than 90°, and the angle can be in a range of 15° to 45°.

In one embodiment, the branched-tubular portion may include a surface line curved from a top side of the branched-tubular portion on the oblique support member to a bottom side of the branched-tubular portion.

In one embodiment, a wall-mounted filtration apparatus for a pool may include a main body having a through hole and a plurality of water inlets; furthermore, a filtering cover may include a water outlet, and a filtering fixed shaft can be positioned on the filtering cover surrounding the water outlet; additionally, a opening can be positioned on a side of the filtering fixed shaft and be parallel with the water outlet; moreover, a filtering portion can be positioned on an outer surface of the filtering fixed shaft, and the main body with the filtering cover can be configured to be a filter casing for covering the filtering portion; in addition, a fastener may pass through the through hole for engaging with filtering fixed shaft by the opening to fasten the main body on the filtering cover.

In one embodiment, the wall-mounted filtration apparatus may include the fastener which is a bolt engaged with a plurality of threads positioned on an inner surface of the opening In one embodiment, the wall-mounted filtration apparatus may include the filtering fixed shaft having a hollow cylinder portion which is interconnected with the water outlet.

In one embodiment, the wall-mounted filtration apparatus may include a plurality of side openings which are positioned on a lateral surrounding portion of the filtering fixed shaft for interconnecting with the hollow cylinder portion. Also, a plurality of protruding portions are interval of positioning on the lateral surrounding portion adjacent to the side openings.

In one embodiment, the wall-mounted filtration apparatus may include the main body (110) which is a cylinder-shaped structure or a cone-shaped structure.

In one embodiment, the wall-mounted filtration apparatus may include the water inlets which are positioned on an outer surface of the main body, and at least a water retaining sheet is positioned on an inner surface of the main body by at least a clamp ring to cover the water inlets.

In one embodiment, the wall-mounted filtration apparatus may include a first fastening portion which is positioned on the inner surface of the main body and a second fastening portion is positioned on an inner surface of the filtering cover. Moreover, the filtering portion may include a filter positioned between a first fastening plate and a second fastening plate. The first fastening plate and the second fastening plate may include a first groove and a second groove; also, the first fastening portion and second fastening portion are coupled with the first fastening plate and the second fastening plate for engaging the filtering portion in the filter casing.

In one embodiment, the wall-mounted filtration apparatus may include a plurality of connecting threads which are positioned on the water outlet for coupling with the pool.

Compared with the prior art, the present disclosure may have a serial of advantages. For example, it may be a simple, safe, firm and stable structure as well as an appealing appearance. Also, it is convenient to install, and provides high utilization of space (occupies small area). Moreover, in the present disclosure, the installation of wall-mounted filtration apparatus in the embodiments may be simple and easy. The filtering portion is positioned inside the filtering cover so that it is not easy to be damaged artificially. Additionally, the filtering cover can be easily disassembled, to achieve the requirements of checking or changing the filtering portion. The water retaining sheets arranged on the inner surface of the main body are used for preventing impurities flow back to the pool.

BRIEF DESCRIPTION OF THE DRAWINGS

The above-mentioned and other features, properties and advantages of the present disclosure will become more apparent from the following description of embodiments with reference to the accompany drawings, in which:

FIG. 15(*b*) is a perspective view of the main body to a wall-mounted filtration apparatus for a pool shown in FIG. 14 according to the embodiment;

DETAILED DESCRIPTION

The present disclosure will be further described below in conjunction with particular example implementations and the accompanying drawings. Further details are provided in the following description in order for the present disclosure to be fully understood. However, the present disclosure can be implemented in various ways other than those described herein. A person skilled in the art can make similar analogies and modifications according to practical applications without departing from the spirit of the present disclosure, and therefore the contents of the particular examples herein should not be construed as limiting to the scope of the present disclosure.

Figure 1:
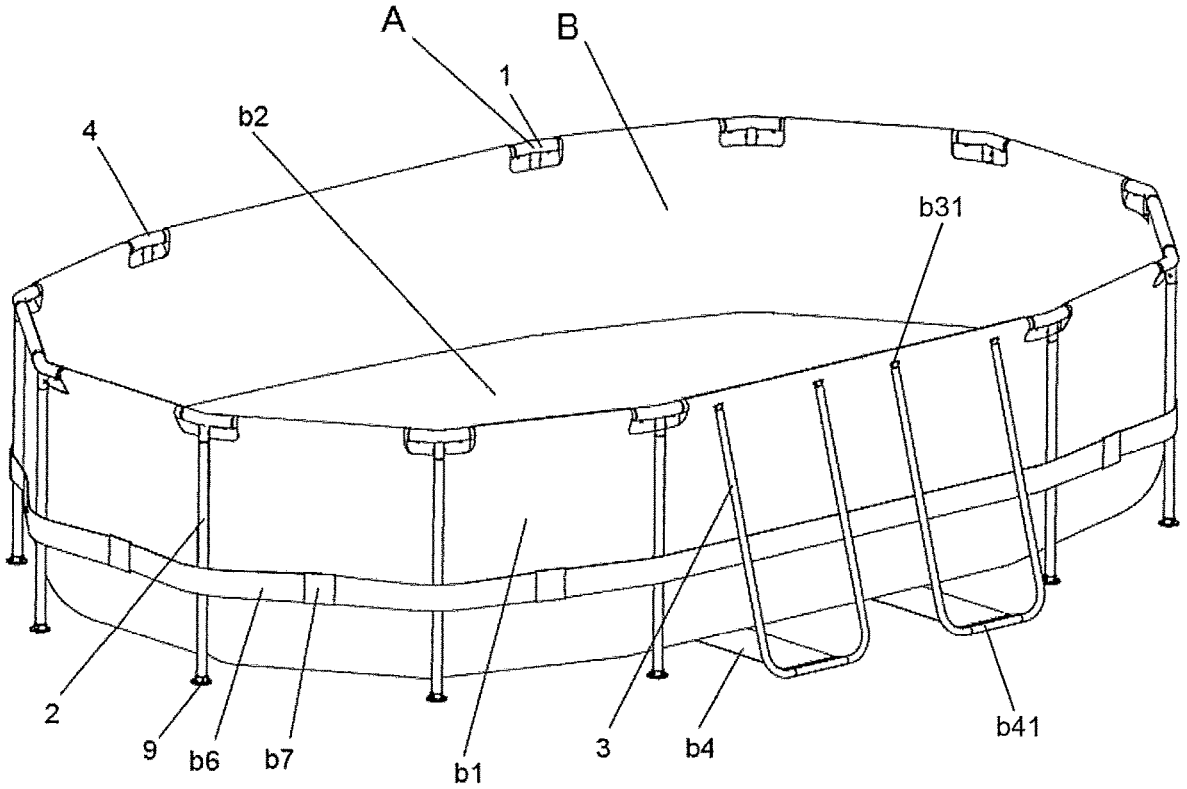
FIG. 1 is a perspective view of a pool with an elliptical frame according to a first embodiment of the present disclosure.
Figure 2:
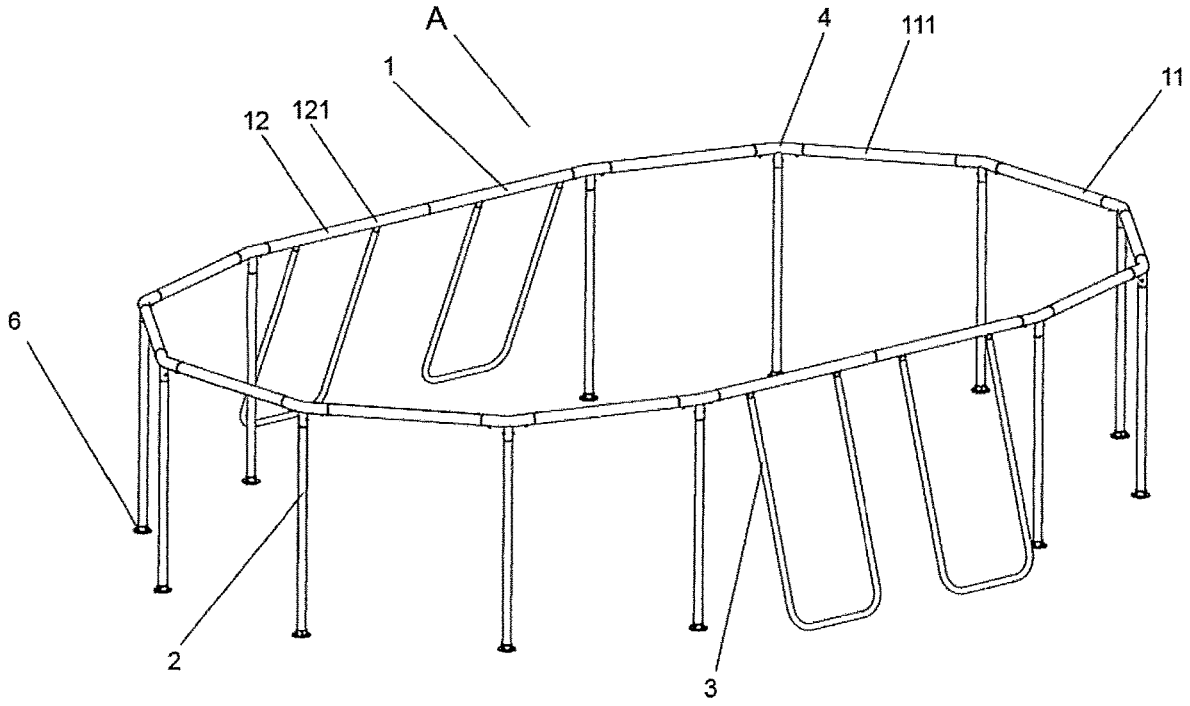
FIG. 2 is a perspective view of a support frame of the pool with an elliptical frame shown in FIG. 1.
Figure 3:
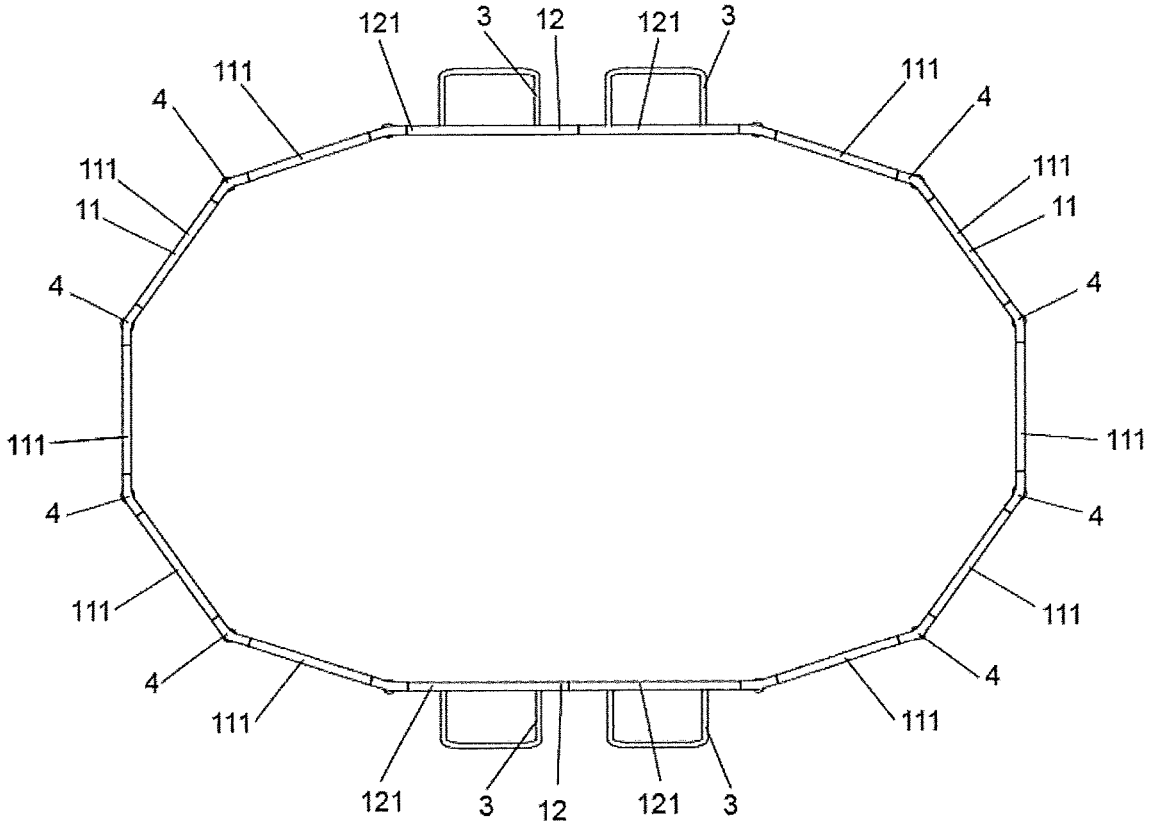
FIG. 3 is a top view of the support frame of the pool with an elliptical frame shown in FIG. 2.
Figure 4:
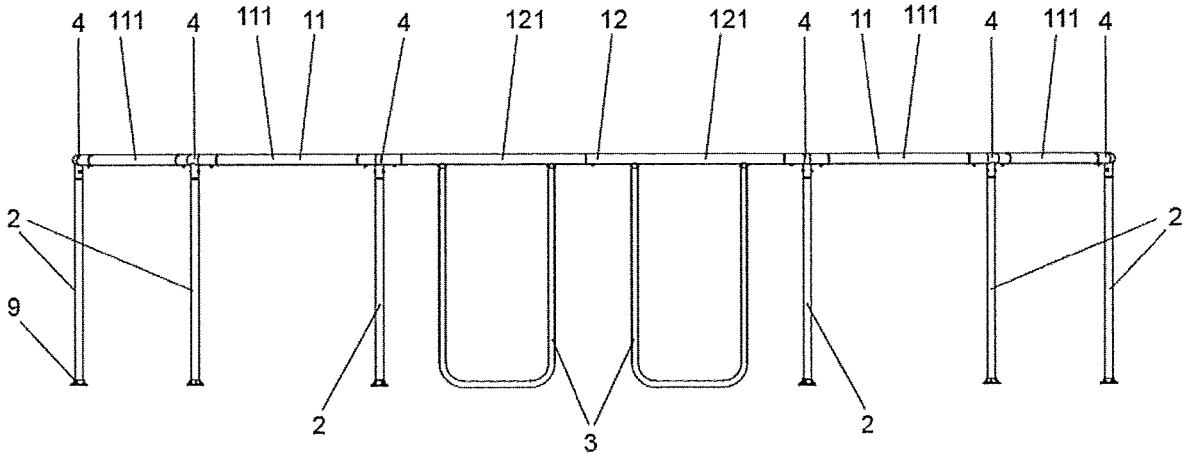
FIG. 4 is a front view of the support frame of the pool with an elliptical frame shown in FIG. 2.
Figure 5:
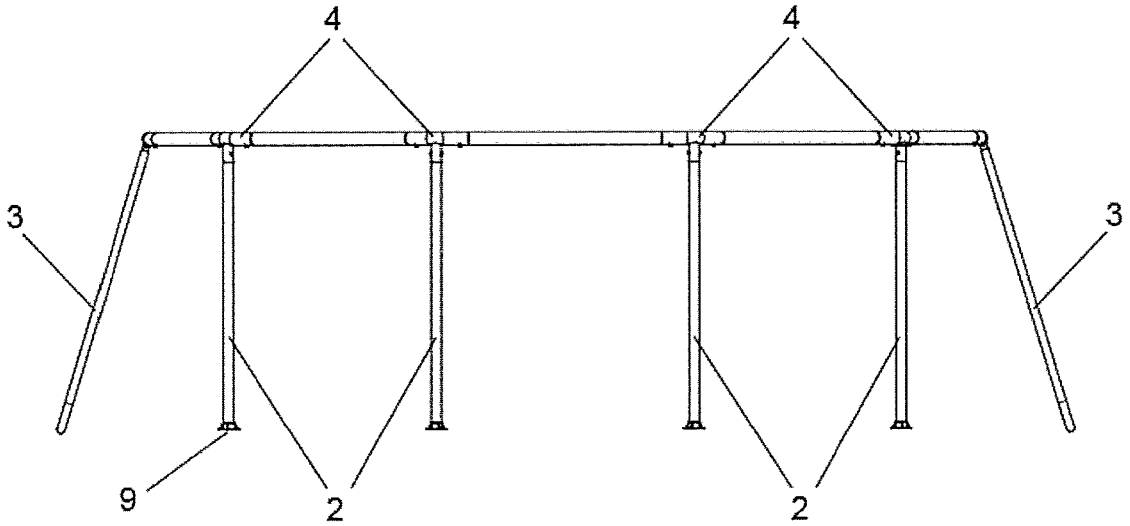
FIG. 5 is a side view of the support frame of the pool with an elliptical frame shown in FIG. 2.

FIG. 1 is a perspective view of a pool with an elliptical frame according to a first embodiment of the present disclosure. FIG. 2 is a perspective view of a support frame of the pool with an elliptical frame shown in FIG. 1. FIG. 3 is a top view of the support frame of the pool with an elliptical frame shown in FIG. 2. FIG. 4 is a front view of the support frame of the pool with an elliptical frame shown in FIG. 2. FIG. 5 is a side view of the support frame of the pool with an elliptical frame shown in FIG. 2. It should be noted that these and other subsequent drawings are merely used as examples, and are not necessarily drawn to scale, and should not be taken as a limitation to the claimed scope of the present disclosure.

Referring to FIGS. 1-5, the pool with an elliptical frame according to the first embodiment of the present disclosure mainly includes a support frame A and a flexible pool liner B which is supported by the support frame A and used for containing water. The support frame A is formed by a plurality of steel tubes which are coupled via steel tube connectors. The flexible pool liner B is made from flexible reinforced polyvinyl chloride (PVC) rubberized fabric or PU rubberized fabric with sandwiched mesh fabric. The support frame A and the flexible pool liner B will be detailed below.

The support frame A includes a horizontal, substantially elliptical upper frame 1, and a plurality of vertical support members 2 and oblique support members 3 for supporting the upper frame 1. Two ends of the upper frame 1 along the major axis direction of the ellipse shape are two opposite arcuate frames 11. Two opposite parallel straight frames 12 having the same length are respectively connected between

DESCRIPTION OF REFERENCE SIGNS

| | | |
|---|---|---|
| A: Support Frame | B: Flexible Pool Liner | 1: Upper Frame |
| 11: Arcuate Frame | 111: First Horizontal Support Tube | 12: Straight Frame |
| 121: Second Horizontal Support Tube | 1211: Oblique Support Hole | 2: Vertical Support Member |
| 3: Oblique Support Leg Tube | 4: T-shaped connector | 5: First Elastic Pin |
| 6: Second Elastic Pin | 7: Third Elastic Pin | 8: Jacket |
| 9: Leg Pad | b1: Pool Wall | b11: First sleeve |
| b2: Pool Bottom | b31: Oblique Support Opening | b4: Oblique Support Tube Drawstring |
| b41: Second Sleeve | b6: Reinforcing Band | b7: Sticker |
| 100: Filter Casing | 110: Main Body | 127: Water Inlet |
| 112: Through Hole | 113: Fastening Portion | 120: filtering Cover |
| 128: Water Outlet | 122: Filter Fixed Shaft | 123: Side Opening |
| 124: Thread | 125: fastening Portion | 126: Connecting Thread |
| 200: Filtering Portion | 210: Fastening Plate | 220: Groove |
| 300: Fastener | 400: Water Retaining Sheet | 500: Clamp Ring |
| 600: Seal Structure | 700: Connector | 710: Connecting Thread |
| 720: Connecting Thread | 800: Base | 810: Connecting Thread |
| 900: Inner Surface | | |

the two arcuate frames 11. The arcuate frames 11 and the straight frames 12 form the closed upper frame 1. Each arcuate frame 11 may include at least two first horizontal support tubes 111 which are coupled to each other, and each first horizontal support tube 111 may be a straight tube. Each segment of straight frame 12 may include at least one second horizontal support tube 121.

Figure 6:
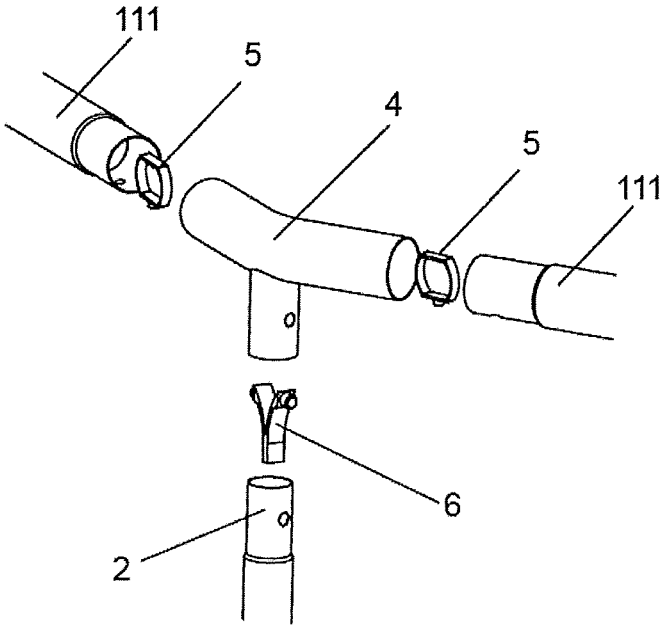
FIG. 6 is an exploded view of two first horizontal support tubes of an arcuate frame, one vertical support member and a T-shaped connector of the pool with an elliptical frame according to the first embodiment of the present disclosure, before assembling.
Figure 7:
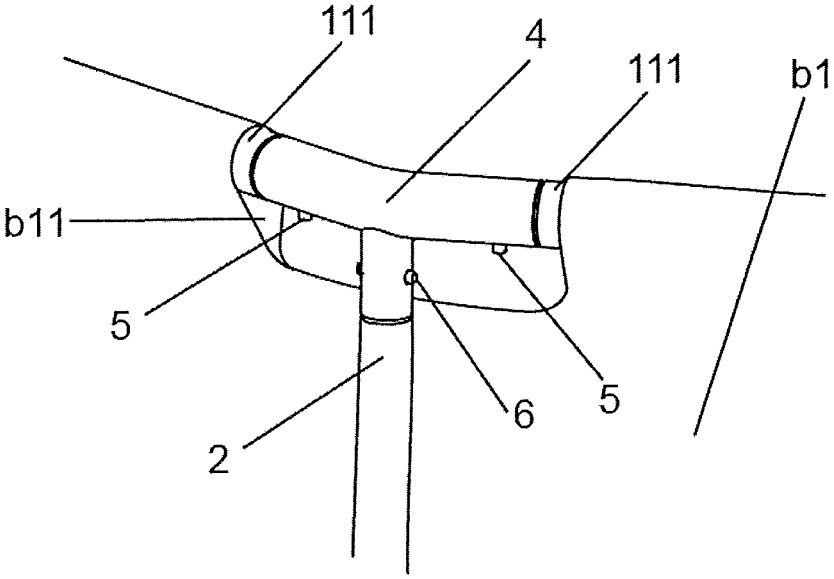
FIG. 7 is a partial perspective view illustrating the two first horizontal support tubes, the vertical support member and the T-shaped connector of the arcuate frame of the pool with an elliptical frame according to the first embodiment shown in FIG. 6, after assembled with a flexible pool liner.
Figure 8:
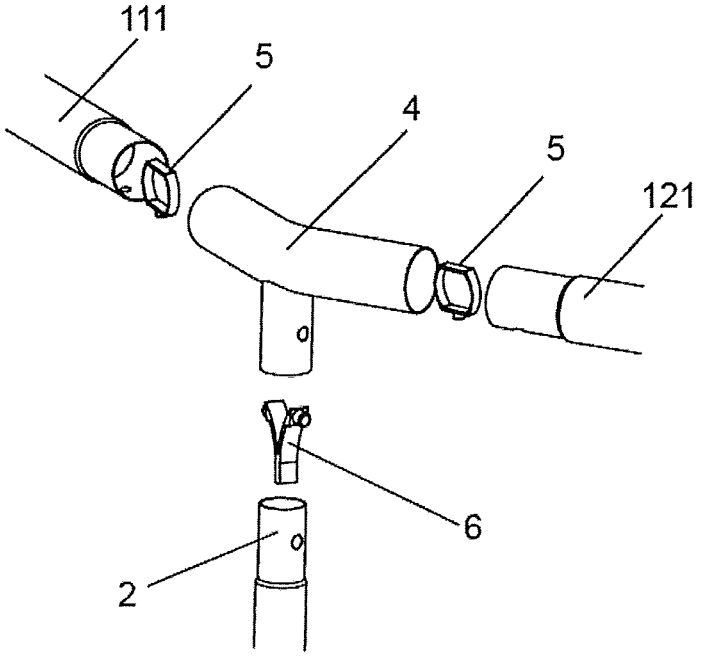
FIG. 8 is an exploded view illustrating one first horizontal support tube of the arcuate frame, one second horizontal support tube of a straight frame, one vertical support member and a T-shaped connector of the pool with an elliptical frame of the first embodiment of the present disclosure, before assembling.
Figure 9:
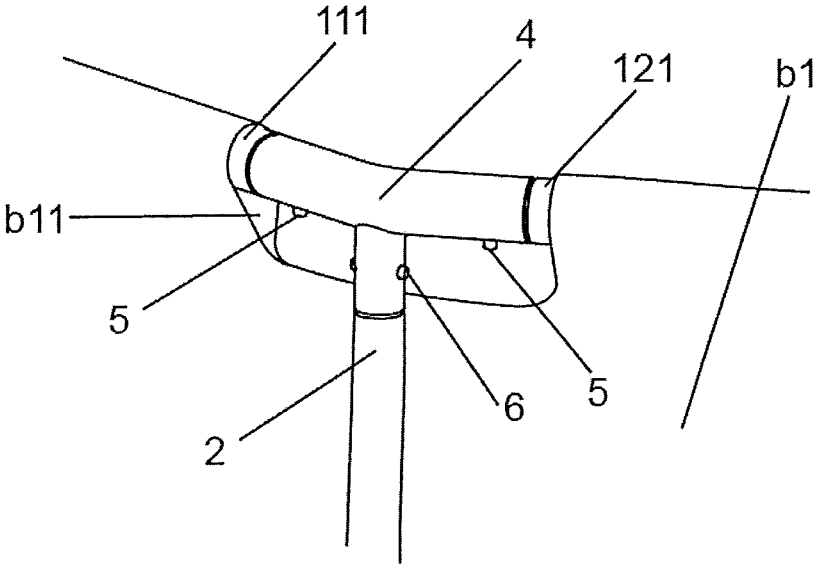
FIG. 9 is a partial schematic view illustrating the first horizontal support tube of the arcuate frame, the second horizontal support tube of the straight frame, the vertical support member and the T-shaped connector of the pool with an elliptical frame according to the first embodiment shown in FIG. 8, after assembled with a flexible pool liner.

FIG. 6 is an exploded view of two first horizontal support tubes of the arcuate frame, one vertical support member and a T-shaped connector of the pool with an elliptical frame, before assembling, according to the first embodiment of the present disclosure. FIG. 7 is a partial view of the two first horizontal support tubes of the arcuate frame, the vertical support member and the T-shaped connector of the pool with an elliptical frame according to the first embodiment shown in FIG. 6, after assembled with a flexible pool liner. FIG. 8 is an exploded view of one first horizontal support tube of the arcuate frame, one second horizontal support tube of a straight frame, one vertical support member and a T-shaped connector of the pool with an elliptical frame according to the first embodiment of the present disclosure before assembling. FIG. 9 is a partial view of the first horizontal support tube of the arcuate frame, the second horizontal support tube of the straight frame, the vertical support member and the T-shaped connector of the pool with an elliptical frame according to the first embodiment shown in FIG. 8, after assembled with a flexible pool liner.

Referring to FIGS. 1-9, a T-shaped connector 4 is fixedly coupled, with the aid of an elastic pin structure, between two adjacent first horizontal support tubes 111 of the arcuate frame 11 and one of vertical support members 2, and between one first horizontal support tube 111 of the arcuate frame 11, one second horizontal support tube 121 of the straight frame 12, and one of vertical support members 2.

Referring to FIGS. 6 and 7, the connection among the two adjacent first horizontal support tubes 111 of the arcuate frame 11, the vertical support member 2 and the T-shaped connector 4 are described as follows. The ends of the first horizontal support tubes 111 and the T-shaped connector 4 are inserted into each other to be fixedly coupled using the first elastic pins 5, which pass through the circular holes in the ends of the first horizontal support tubes 111 and in the ends of the T-shaped connector 4. The upper end of the vertical support member 2 and the lower end of the T-shaped connector 4 are inserted into each other and are fixedly coupled via a second elastic pin 6 in the vertical support member 2, which passes through circular holes in the upper end of the vertical support member 2 and the lower end of the T-shaped connector 4.

Referring to FIGS. 8 and 9, the connection among the first horizontal support tube 111 of the arcuate frame 11, the second horizontal support tube 121 of the straight frame 12, and the vertical support member 2, and the T-shaped connector 4 are described as follows. The ends of the first horizontal support tube 111 of the arcuate frame 11 and the second horizontal support tube 121 of the straight frame 12 and the left and right ends of the T-shaped connector 4 are inserted into each other to be fixedly coupled by the first elastic pins 5 passing through the circular holes in the end of the first horizontal support tube 111, the second horizontal support tube 121, and the T-shaped connector 4. The upper end of the vertical support member 2 and the lower end of the T-shaped connector 4 are inserted into each other to be fixedly coupled using the second elastic pin 6 in the vertical support member 2 passing through the circular holes in the upper end of the vertical support member 2 and the lower end of the T-shaped connector 4. The lower end of the vertical support member 2 is provided with a leg pad 9.

Referring to FIGS. 2-5, lower parts of the second horizontal support tubes 121 on two sides of the straight frame 12 are both provided with an oblique support member 3 having a flat bottom and being substantially U-shaped. The oblique support member 3 is used for upwardly and inwardly supporting the second horizontal support tubes 121, so as to prevent the straight frame 12 from bending towards the outside of the pool, after the pool is filled with water. Preferably, the overall shape of the oblique support member 3 is not limited to U shape. It may also be, for example, an inverted T shape (not shown), and its installation to the second horizontal support tube 121 is similar to that of the U-shaped oblique support member 3.

Figure 10:
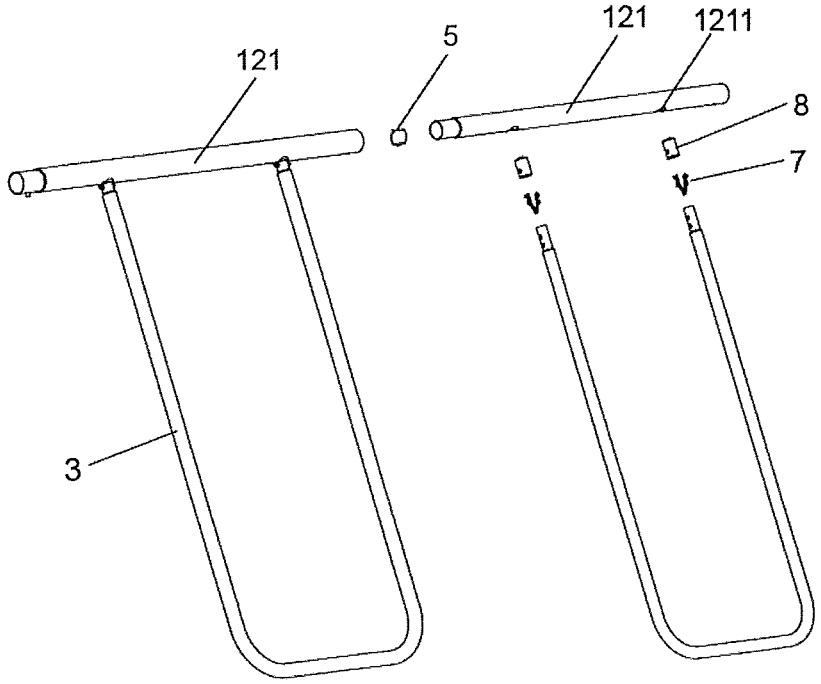
FIG. 10 is a schematic assembled view illustrating the second horizontal support tube of the straight frame and an oblique support member of the pool with an elliptical frame according to the first embodiment of the present disclosure.

FIG. 10 is an assembled view of the second horizontal support tube of the straight frame and an oblique support member of the pool with an elliptical frame according to the first embodiment of the present disclosure. As shown in FIG. 10, firstly, each straight frame 12 may also include at least two second horizontal support tubes 121. The two second horizontal support tubes 121 are inserted into each other and are fixedly coupled via the first elastic pin 5. Secondly, the method for fixedly connecting the second horizontal support tube 121 of the straight frame 12 with the oblique support member 3 may be as follows. A lower surface of each second horizontal support tube 121 is provided with at least one pair of oblique support holes or at least one oblique support hole 1211 with a diameter slightly greater than an external diameter of the oblique support member 3 (FIG. 10 shows a solution in the case of a pair of oblique support holes). Both ends of the U-shaped oblique support member 3 are provided with a plastic jacket 8 and a third elastic pin 7, and the two ends of the oblique support member 3 are respectively inserted into the pair of oblique support holes 1211 in the lower part of the second horizontal support tube 121 of the straight frame 12, and are fixedly connected to the second horizontal support tube 121 of the straight frame 12 by means of snap-fitting the third elastic pin 7 of the oblique support member 3 with an inner wall of the second horizontal support tube 121, so as to the support the straight frame 12. Preferably, if the oblique support member is an inverted T-shaped tube instead of the U-shaped tube, the upper end of the oblique support member can also be provided with a plastic jacket and a third elastic pin, and then the upper end thereof is inserted into one oblique support hole 1211 in the lower part of the second horizontal support tube 121 for supporting the straight frame 12.

Figure 11:
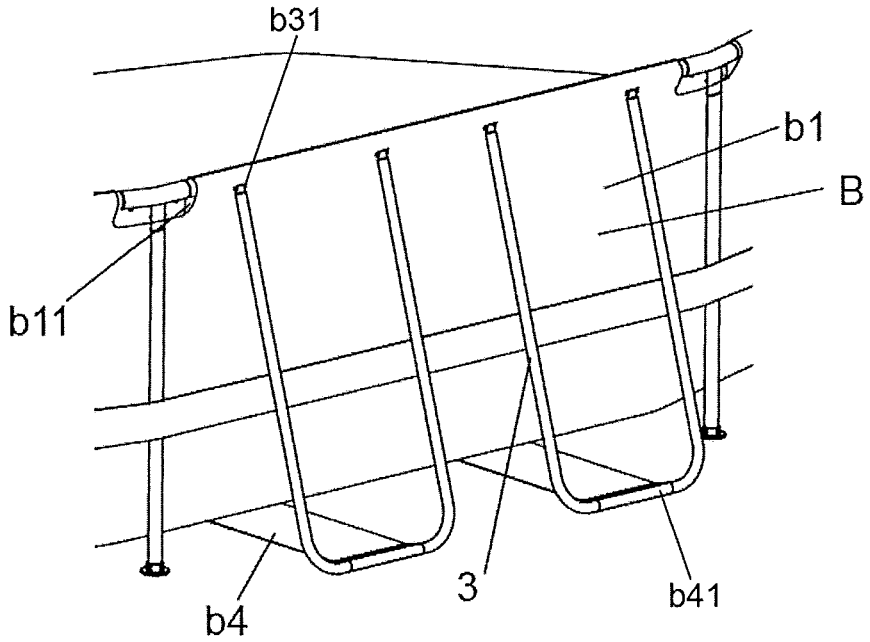
FIG. 11 is a perspective structural view illustrating the second horizontal support tube of the straight frame, and the oblique support member of the pool with an elliptical frame according to the first embodiment of the present disclosure, after assembled with a flexible pool liner.

FIG. 11 is a perspective view illustrating the second horizontal support tube of the straight frame, and the oblique support member of the pool with an elliptical frame according to the first embodiment of the present disclosure, after assembled with a flexible pool liner. Referring to FIGS. 1, 7, 9 and 11, the flexible pool liner B is situated inside the support frame A, which includes a pool wall b1 and an elliptical pool bottom b2. A lower edge of the pool wall b1 and an edge of the pool bottom b2 are coupled to each other, so as to form an open container capable of containing water. The upper edge of the pool wall b1 is provided with a plurality of first sleeves b11 allowing the first horizontal support tubes 111 and the second horizontal support tubes 121 of the upper frame 1 to be sheathed therein, so as to fix the flexible pool liner B to the upper frame 1. Each first sleeves b11 at the position of the second horizontal support tube 121 is provided with a pair of oblique support openings or an oblique support opening b31 corresponding to the oblique support hole(s) 1211 in the lower surface of the second horizontal support tube 121, which is used to allow the two ends or upper end of the oblique support member 3 to penetrate therethrough so as to connect to the oblique support hole(s) 1211 therein.

In addition, at a position from one-quarter to one-half of the height (for example, one-third of the height) from bottom to top, the pool wall b1 is provided with a surrounding reinforcing band b6. The reinforcing band b6 may be attached to the pool wall b1 via a plurality of stickers b7 on the pool wall b1. The vertical support member 2 is situated between the pool wall b1 and the reinforcing band b6, and this structural design can well define the shape of the flexible pool liner B and the position of the vertical support member 2, so as to prevent the outward bulging of the pool wall b1 and the displacement of the vertical support member 2 after the flexible pool liner B is filled with water.

Figure 12:
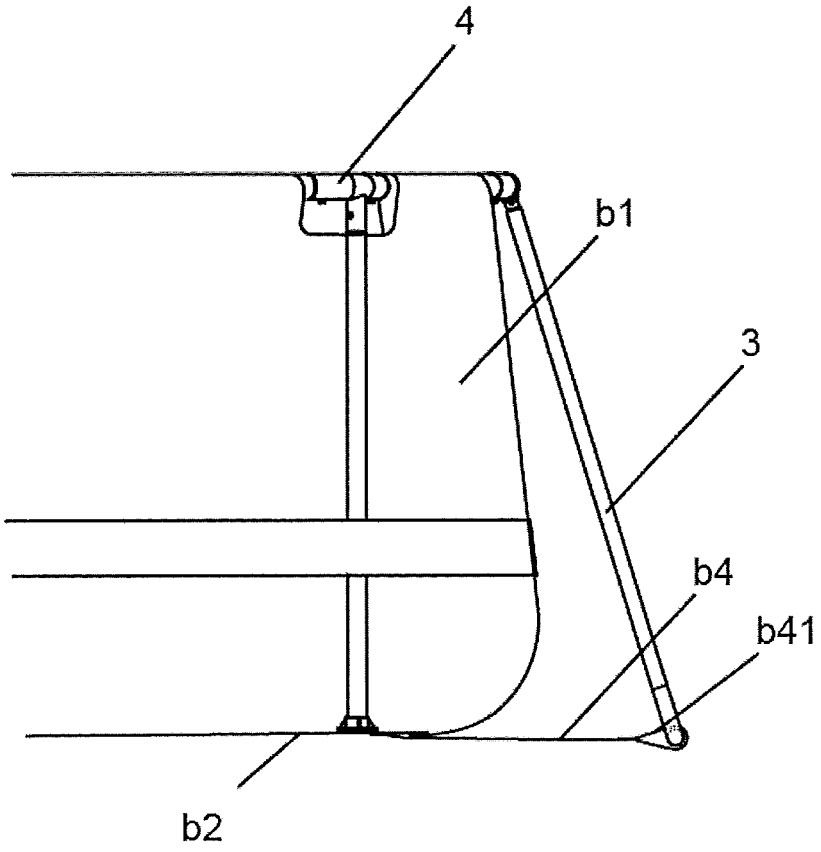
FIG. 12 is a side view illustrating the second horizontal support tube of the straight frame, and the oblique support member of the pool with an elliptical frame according to the first embodiment shown in FIG. 11, after assembled with a flexible pool liner.

FIG. 12 is a side view of the second horizontal support tube of the straight frame and the oblique support member of the pool with an elliptical frame shown in FIG. 11, after assembled with the flexible pool liner. Referring to FIGS. 11 and 12, a plurality of oblique support tube drawstrings b4 are provided between the pool bottom b2 of the flexible pool liner B and the oblique support member 3. The oblique support tube drawstring b4 is fixedly coupled to the pool bottom b2 at one end thereof, and is provided with a second sleeve b41 at the other end thereof. The bottom end of the oblique support member 3 is sheathed into the second sleeve b41 of the oblique support tube drawstring b4, such that the position of the oblique support member 3 is limited by the oblique support tube drawstring b4. When the pool liner B is filled with water, the outward sliding of the oblique support member 3 is prevented.

Figure 13:
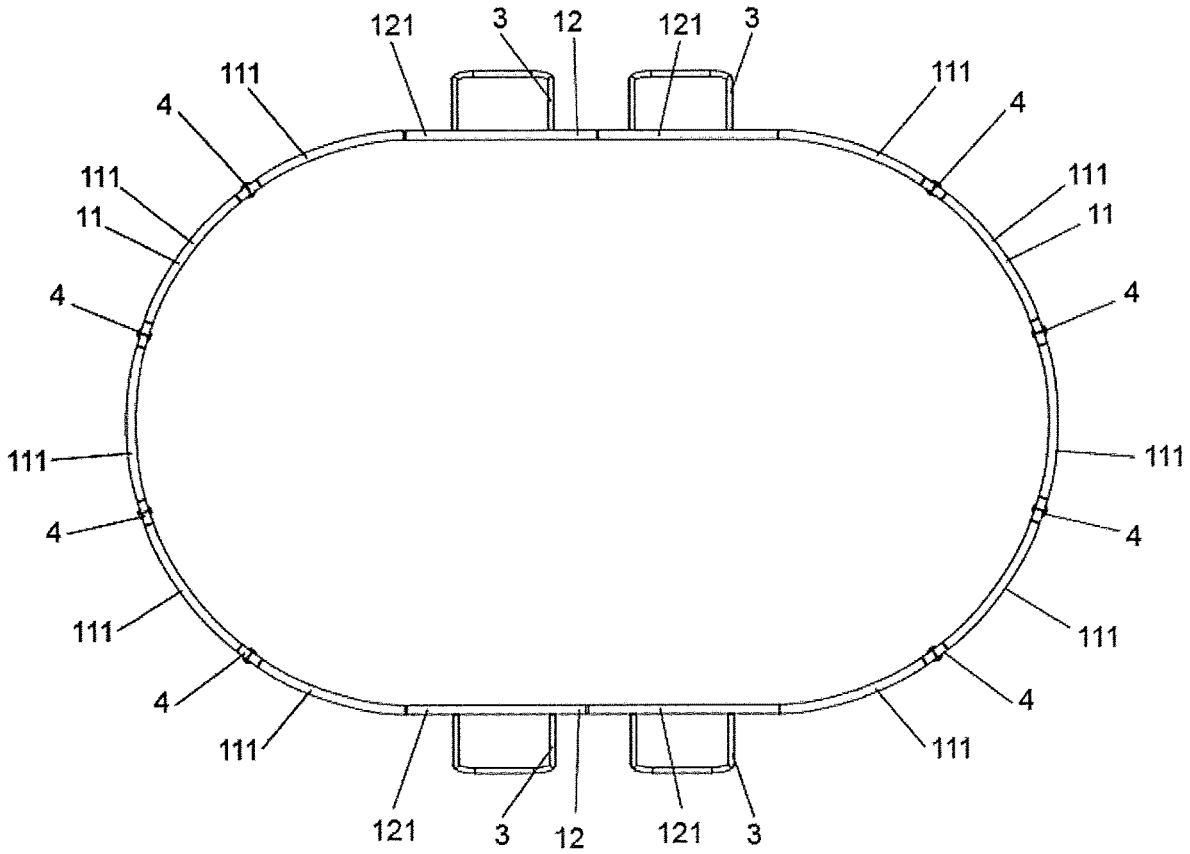
FIG. 13 is a top view of a pool with an elliptical frame according to a second embodiment of the present disclosure, wherein the first horizontal support tubes of two arcuate frames are arcuate.
Figure 14:
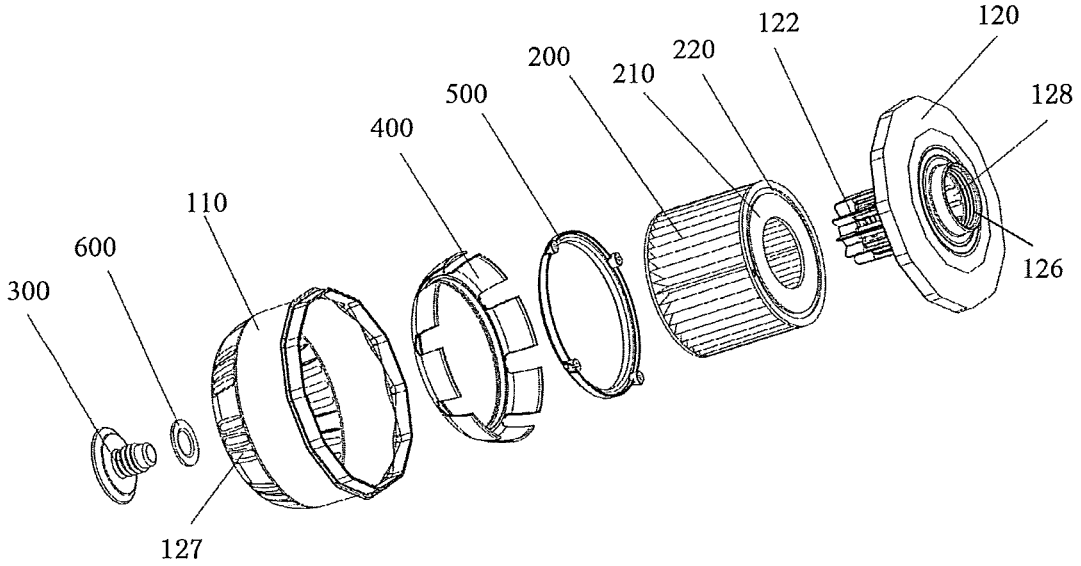
FIG. 14 is an exploded perspective view of a wall-mounted filtration apparatus for a pool according to an embodiment of the present disclosure.
Figure 15A:
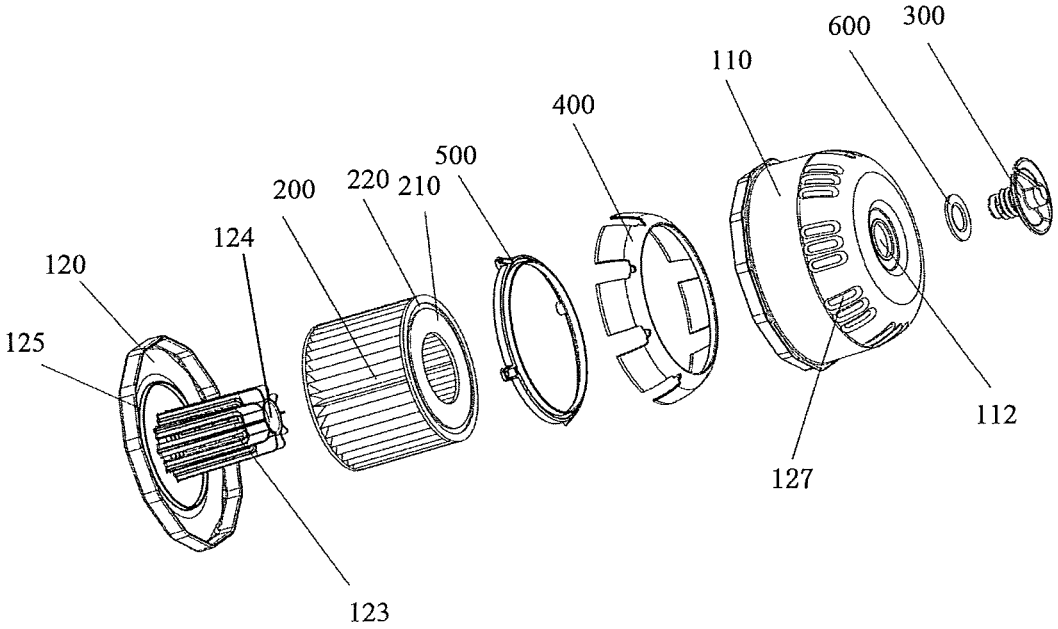
FIG. 15(*a*) is an exploded perspective view of a wall-mounted filtration apparatus for a pool shown in FIG. 14.
Figure 15B:
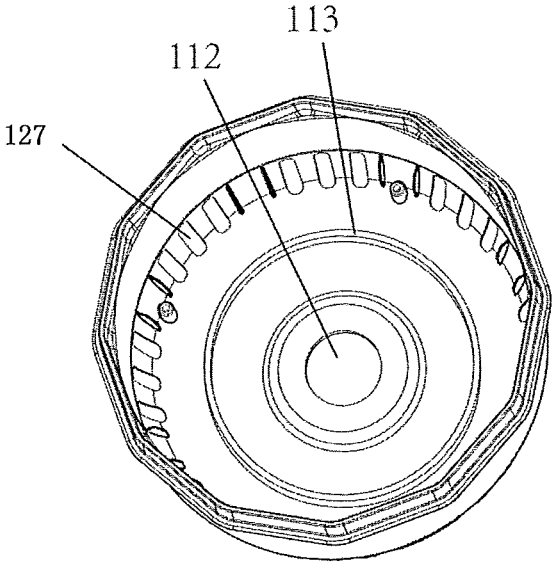
Figure 16:
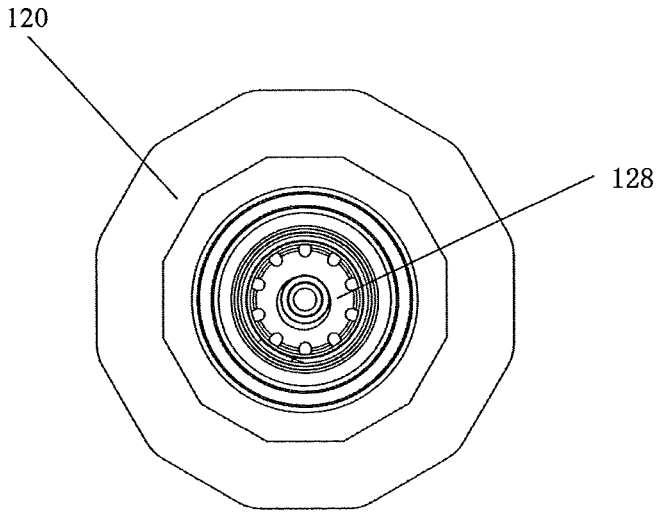
FIG. 16 is a front view of a wall-mounted filtration apparatus for a pool shown in FIG. 14.
Figure 17:
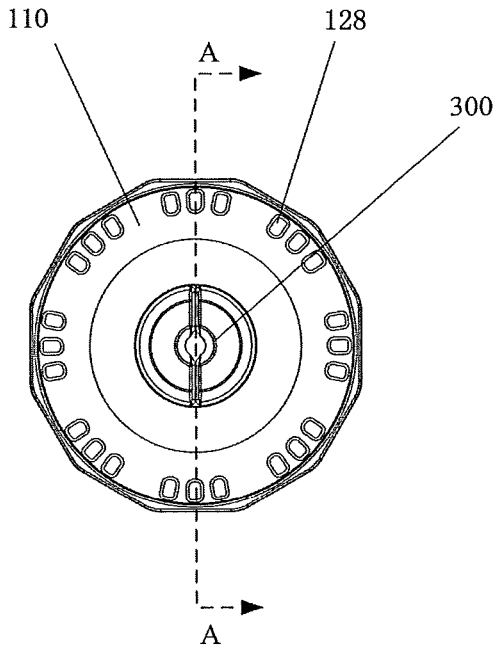
FIG. 17 is a rear view of a wall-mounted filtration apparatus for a pool shown in FIG. 14.
Figure 18:
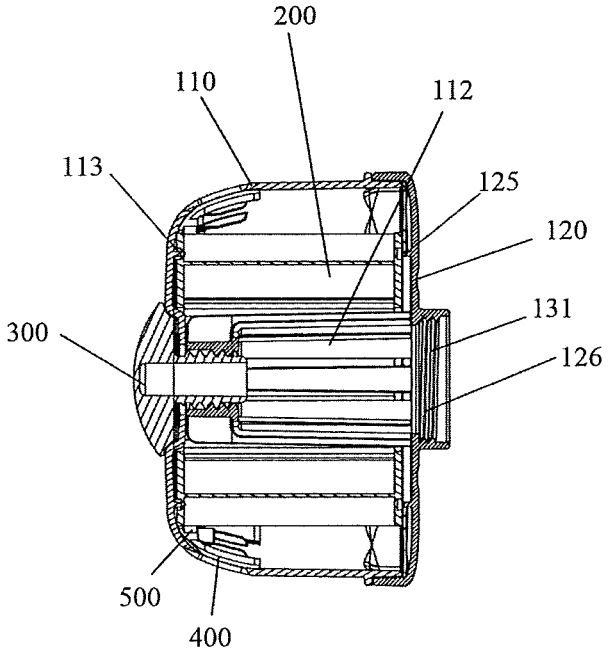
FIG. 18 is a sectional view of a wall-mounted filtration apparatus for a pool depending on FIG. 17 in the direction of the arrows upon line 4-4 according to the embodiment.

FIG. 13 is a top view of a pool with an elliptical frame according to a second embodiment of the present disclosure, with first horizontal support tubes of two segments of arcuate frames being arcuate. This second embodiment continues to use the same reference signs in the first embodiment, wherein like reference signs denote the same or similar parts. However, the description of the same technical content is selectively omitted for brevity. With regard to the description of the omitted part, references can be made to the preceding embodiment, and no redundant description will be provided in the present embodiment.

In the present second embodiment, both the first horizontal support tubes 111 of the two arcuate frames 11 may be arcuate tubes, so that the support frame A of the frame pool has a more smooth oval shape, while the remaining structure is the same as in the first embodiment.

In the present disclosure, the illustration of the pool including the elliptical frame structure is described above. Also, the pool can be arranged the wall-mounted filtration apparatus to achieve the requirements of filtering the pool water. The embodiments of the wall-mounted filtration apparatus is illustrated as follows.

Referring to FIGS. 14-19, a wall-mounted filtration apparatus embodying the structure of the present disclosure will be described.

The present disclosure is wall-mounted filtration apparatus including a main body (110), a filtering cover 120, a filtering portion 200 and a fastener 300.

The filtering cover 120 and the main body 110 are configured to be a filter casing (100). The main body 110 can be a cylinder-shaped structure or a cone-shaped structure. The main body 110 having a plurality of water inlets 127 arranged on the outer surface of the main body 110. In the embodiment, the water inlets 127 are positioned on the main body 110 surrounding the lateral wall of the outer surface. Furthermore, a through hole 112 for being passed through a fastener 300 is located on the center of the bottom of main body 110. Also, a plurality of fastening portions 113 are positioned on an inner surface of main body 110 around the through hole 112. The filtering cover 120 includes a water outlet 128 with which a filter fixed shaft 122 is arranged to be coupled. Specifically, the filter fixed shaft 122 is a tubular structure with a hollow cylinder portion for interconnecting with the water outlet 128; additionally, a plurality of threads 126 are positioned on the water outlet 128 in one side opposite the filter fixed shaft 122 for coupling with the connector 700. The filter fixed shaft 122 may have a tubular structure, and a plurality of side openings 123 may be positioned on a side wall of the filter fixed shaft 122. Also, a fastening portion 125 is arranged on the inner surface of the filtering cover 120 surrounding the filter fixed shaft 122.

The filtering portion 200, which having a axis with the filter fixed shaft 122, is located in a space between the filtering cover 120 and the main body 110, and is inserted to joint on the filter fixed shaft 122. The filtering portion 200 includes a first fastening plate and a second fastening plate 210 and a filter positioned between the two fastening plate 210. The filter can be one or more of folded non-woven, polyester fibers or sponges. Those of two fastening plates 210 are respectively positioned on both two side of the filtering portion 200) for fastening the filtering portion 200 between the filtering cover 120 and the main body 110. Specifically, each of fastening plate 210 includes a groove 220. In the embodiment, the first fastening plate 210 being towards to the main body 110 is used to couple with the first fastening portion 113 on the inner surface of the main body 110 by the first groove 220, whereas the second fastening plate 210 being towards to the filtering cover 120 is used to couple with the second fastening portion 125 on the inner surface of the filtering cover 120 by second groove 220, to fasten the filtering portion 200 between the filtering cover 120 and the main body 110.

In one embodiment, the fastening portion 113, 125 is a closed ring. Another can be a discontinuous fastening rings which having a plurality of intervals in a circumferential direction. The fastener 300 can be a bolt passing through the main body 110 by the through, and be engaged with a plurality of threads 124 on filter fixed shaft 122 for coupled both to be a combination. A same axis for the main body 110 and the filter fixed shaft 122 is through the engagement between the threads 124 and the fastener 300. In the embodiment, seal structures 600 can be located between the fastener 300 and the main body 110 for achieving a sealing function.

When the wall-mounted filtration apparatus is filtering, the water enters through the inlet 111 into the main body 110, and then passes through the filter of the filtering portion 200. Subsequently, the water flows into the hollow cylinder portion of the filter fixed shaft 122 by passing through the side openings 123 on the filter fixed shaft 122. Finally, the filtered water flows out the filter casing 100 from the water outlet 128 of the filtering cover 120.

In the embodiment, there are a plurality of water retaining sheets 400 being arranged on the inner surface of the main body 110 used for covering the water inlets 127. The water retaining sheets 400 are fixed on the inner surface using a clamp ring 500. The material of the water retaining sheet 400 can be rubber, PVC or other flexible flaky materials. The function of the water retaining sheet 400 is similar with slice of check valve.

The water retaining sheet 400 will open inward when water enter into the filter casing 100 through inlets 111 in filtering state, whereas the water retaining sheet 400 will cover the inlets 111 for preventing impurities back-flow.

Figure 19:
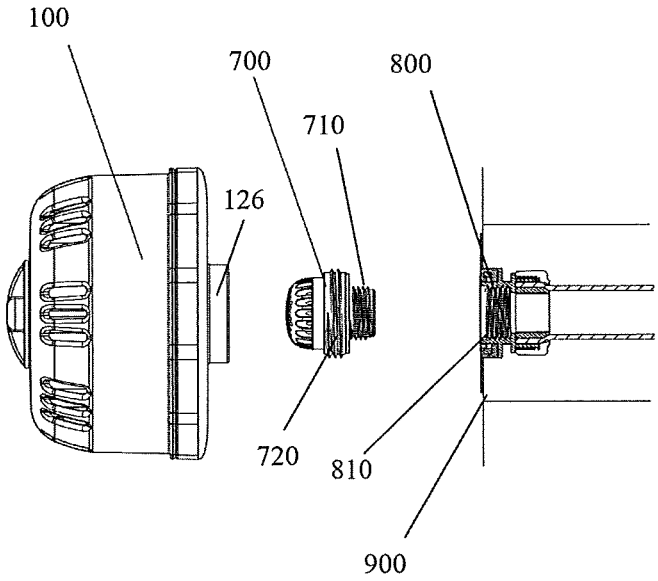
FIG. 19 is a partial perspective view illustrating an installing wall-mounted filtration apparatus according to the embodiment.

The installation of the wall-mounted filtration apparatus is illustrated in FIG. 19.

Base 800 is installed on the inner surface 900 of pool. The connecting threads 710 positioned on the connector 700 are coupled with the plurality of connecting threads 810 positioned on the base 800. Moreover, the plurality of connecting threads 720 on the connector 700 is coupled with the plurality of connecting threads 126 on the water outlet 128 of the filtering cover 120. The present disclosure of the wall-mounted filtration apparatus using those connecting structures can be arranged on the inner surface 900 of pool.

The present disclosure has been described above in connection with example implementations which, however, are not intended to be limiting to the scope of the present disclosure, and any person skilled in the art should understand that these are merely illustrative and could make possible changes and modifications without departing from the spirit and scope of the present disclosure. Hence, any alteration, equivalent change and modification which are made to the above-mentioned examples in accordance with the technical substance of the present disclosure and without departing from the spirit of the present disclosure, would fall within the scope defined by the claims of the present disclosure.

What is claimed is:

1. A pool with an elliptical frame, comprising:

a support frame comprising:

an elliptical upper frame arranged horizontally, a plurality of vertical support members and a plurality of oblique support members supporting the upper frame; and a flexible pool liner that is supported by the support frame and includes a pool wall and a pool bottom coupled to one another for containing water, wherein the elliptical upper frame comprises:

two arcuate frames, each arcuate frame being positioned at an opposite end of the elliptical upper frame along a major axis direction and wherein each arcuate frame comprises at least two first horizontal support tubes, a plurality of straight frames being coupled in parallel between the arcuate frames, each straight frame comprising at least one second horizontal support tube and wherein each first horizontal support tube of said at least two first horizontal support tubes has an arcuate shape, each second horizontal support tube of said at least one second horizontal support tube is linear, and the upper frame is configured by combining the arcuate frames and the straight frames, and a lower surface of each second horizontal support tube having one or more oblique support holes for connecting a respective one of the plurality of oblique support members, a diameter of each oblique support hole is larger than an external diameter of the respective one of the plurality of oblique support members, and the respective one of the plurality of oblique support members being fixedly connected to the corresponding at second horizontal support tube by an elastic pin structure that contacts an inner wall of the corresponding second horizontal support tube, wherein the elastic pin structure comprises an elastic pin and a plastic jacket provided at an upper end of each of the oblique support members, the upper end of each of a respective oblique support members being inserted into the oblique support hole located in the lower surface of the second horizontal support tube by snap-fitting the elastic pin with an inner wall of the second horizontal support tube;

wherein the plurality of oblique support members is disposed between the arcuate frames and the plurality of vertical support members is disposed along the arcuate frames;

wherein the plurality of oblique support members are disposed at an angle away from the flexible pool liner and the plurality of vertical support members are disposed at another angle relative the flexible pool liner; and wherein a T-shaped connector is coupled, by a plurality of elastic pin structures, between two of the at least two first horizontal support tubes and one of the plurality of vertical support members.

2. The pool of claim 1, wherein each straight frame comprises at least two second horizontal support tubes, and the second horizontal support tubes are inserted into each other and are fixedly coupled via a second elastic pin structure.

3. The pool of claim 2, wherein a T-shaped connector is coupled, by a plurality of elastic pin structures, between one of the at least two first horizontal support tubes, one of the at least two second horizontal support tubes, and one of the plurality of vertical support members.

4. The pool of claim 1, wherein each of the oblique support members is a U shaped tube, comprising two ends being respectively inserted into a pair of the one or more oblique support holes, to support the straight frame.

5. The pool of claim 1, wherein the flexible pool liner is a flexible reinforced fabric comprising a mesh fabric having one of polyvinyl chloride and polyurethane.

6. The pool of claim 5, wherein an upper edge of the pool wall is provided with a plurality of first sleeves allowing the first horizontal support tubes and the second horizontal support tubes of the upper frame to be sheathed therein, so as to fix the flexible pool liner to the upper frame.

7. The pool of claim 6, wherein at least one oblique support tube drawstring is fixedly coupled to the pool bottom at one end and is provided with a second sleeve at the other end and wherein a bottom end of one of the oblique support members is sheathed into the second sleeve and the position thereof is limited by the oblique support tube drawstring.

* * * * *